US012104272B2

(12) United States Patent
Post et al.

(10) Patent No.: US 12,104,272 B2
(45) Date of Patent: Oct. 1, 2024

(54) TREATED SUBSTRATES

(71) Applicant: PRC-DeSoto International, Inc., Sylmar, CA (US)

(72) Inventors: Gordon L. Post, Pittsburgh, PA (US); Michael A. Mayo, Pittsburgh, PA (US); Edward F. Rakiewicz, Gibsonia, PA (US); Michael J. Pawlik, Glenshaw, PA (US)

(73) Assignee: PRC-DESOTO INTERNATIONAL, INC., Slymar, CA (US)

( * ) Notice: Subject to any disclaimer, the term of this patent is extended or adjusted under 35 U.S.C. 154(b) by 0 days.

(21) Appl. No.: 18/169,148

(22) Filed: Feb. 14, 2023

(65) Prior Publication Data

US 2023/0203699 A1 Jun. 29, 2023

(51) Int. Cl.

| | |
|---|---|
| ***C25D 5/34*** | (2006.01) |
| ***C25D 9/08*** | (2006.01) |
| ***C25D 9/10*** | (2006.01) |
| ***C25D 9/12*** | (2006.01) |

(52) U.S. Cl.

CPC ..... *C25D 5/34* (2013.01); *C25D 9/08* (2013.01); *C25D 9/10* (2013.01); *C25D 9/12* (2013.01)

(58) Field of Classification Search

None

See application file for complete search history.

(56) References Cited

U.S. PATENT DOCUMENTS

| | | | | |
|---|---|---|---|---|
| 3,912,548 | A | 10/1975 | Faigen | |
| 5,030,323 | A | 7/1991 | Awad | |
| 5,089,064 | A | 2/1992 | Reghi | |
| 5,328,525 | A | 7/1994 | Musingo et al. | |
| 5,449,415 | A | 9/1995 | Dolan | |
| 5,458,698 | A | 10/1995 | Bershas et al. | |
| 5,584,943 | A | 12/1996 | Banaszak et al. | |
| 5,653,823 | A | 8/1997 | McMillen et al. | |
| 5,662,746 | A | 9/1997 | Affinito | |
| 5,932,083 | A | 8/1999 | Stoffer et al. | |
| 6,090,224 | A | 7/2000 | Wichelhaus et al. | |
| 6,306,276 | B1 | 10/2001 | Nobe et al. | |
| 6,312,812 | B1 | 11/2001 | Hauser et al. | |
| 6,355,832 | B1 | 3/2002 | Weferling et al. | |
| 6,534,673 | B1 | 3/2003 | Weferling et al. | |
| 6,818,116 | B2 | 11/2004 | Stoffer et al. | |
| 7,048,807 | B2 | 5/2006 | Stoffer et al. | |
| 7,241,371 | B2 | 7/2007 | Stoffer et al. | |
| 7,759,419 | B2 | 7/2010 | Stoffer et al. | |
| 8,182,874 | B2 | 5/2012 | Kolberg et al. | |
| 8,298,350 | B2 | 10/2012 | Cano-Iranzo et al. | |
| 8,628,689 | B2 | 1/2014 | Visser et al. | |
| 8,673,091 | B2 | 3/2014 | McMillen et al. | |
| 2002/0043168 | A1 | 4/2002 | Mayers et al. | |
| 2002/0084002 | A1* | 7/2002 | Hardin | C23C 22/57 427/430.1 |
| 2003/0121569 | A1 | 7/2003 | Minevski et al. | |
| 2003/0172998 | A1 | 9/2003 | Wojcik et al. | |
| 2003/0230363 | A1 | 12/2003 | Sturgill et al. | |
| 2003/0230364 | A1 | 12/2003 | Greene et al. | |
| 2004/0026260 | A1* | 2/2004 | Stoffer | C25D 9/12 205/213 |
| 2004/0028820 | A1 | 2/2004 | Stoffer et al. | |
| 2004/0163736 | A1* | 8/2004 | Matsukawa | C23C 22/34 148/247 |
| 2004/0167266 | A1 | 8/2004 | Hasegawa et al. | |
| 2004/0232819 | A1 | 11/2004 | Huang et al. | |
| 2006/0113007 | A1* | 6/2006 | Morris | C23C 22/83 148/273 |
| 2007/0272900 | A1 | 11/2007 | Yoshida et al. | |
| 2008/0145678 | A1 | 6/2008 | McMurdie et al. | |
| 2011/0024298 | A1 | 2/2011 | Nishiguchi et al. | |
| 2011/0062026 | A1 | 3/2011 | Nishiguchi et al. | |
| 2011/0083580 | A1 | 4/2011 | Cheng et al. | |

(Continued)

FOREIGN PATENT DOCUMENTS

| | | |
|---|---|---|
| CA | 2057825 | 6/1992 |
| CA | 2087352 | 1/1994 |
| CN | 101285184 | 10/2008 |
| CN | 101560655 | 10/2009 |
| CN | 102222574 | 10/2011 |
| CN | 102242364 | 11/2011 |
| CN | 102314090 | 1/2012 |
| CN | 102703891 | 10/2012 |
| CN | 102787312 | 11/2012 |

(Continued)

OTHER PUBLICATIONS

Pinc et al., "Corrosion Protection of Cerium-based Conversion Coatings with Subsurface Crevices", ECS Transactions, (2010), vol. 28, No. 24, pp. 187-201.

*Primary Examiner* — Daniel J. Schleis

(74) *Attorney, Agent, or Firm* — Alicia M. Passerin

(57) ABSTRACT

Methods for treating a substrate are disclosed. The substrate is deoxidized and then immersed in an electrodepositable pretreatment composition comprising a lanthanide series element and/or a Group IIIB metal, an oxidizing agent, and a metal-complexing agent to deposit a coating from the electrodepositable pretreatment composition onto a surface of the substrate. Optionally, the electrodepositable pretreatment composition may comprise a surfactant. A coating from a spontaneously depositable pretreatment composition comprising a Group IIIB and/or Group IVB metal may be deposited on the substrate surface prior to electrodepositing a coating from the electrodepositable pretreatment composition. Following electrodeposition of the electrodepositable pretreatment composition, the substrate optionally may be contacted with a sealing composition comprising phosphate and a Group IIIB and/or IVB metal. Substrates treated according to the methods also are disclosed.

20 Claims, No Drawings

(56) References Cited

U.S. PATENT DOCUMENTS

| | | | |
|---|---|---|---|
| 2011/0189488 | A1 | 8/2011 | Kolberg et al. |
| 2012/0052307 | A1 | 3/2012 | Plieth et al. |
| 2012/0145039 | A1 | 6/2012 | Silvernail et al. |
| 2013/0034742 | A1 | 2/2013 | Silvernail et al. |
| 2014/0011048 | A1 | 1/2014 | Kwak et al. |
| 2014/0255706 | A1 | 9/2014 | Kolberg et al. |
| 2017/0101721 | A1 | 4/2017 | Post et al. |

FOREIGN PATENT DOCUMENTS

| | | |
|---|---|---|
| CN | 102851659 | 1/2013 |
| CN | 102876185 | 1/2013 |
| CN | 102877052 | 1/2013 |
| CN | 102877053 | 1/2013 |
| CN | 102965653 | 3/2013 |
| CN | 103103512 | 5/2013 |
| CN | 102433559 | 9/2013 |
| CN | 103498179 | 1/2014 |
| DE | 19723350 | 12/1998 |
| EP | 0008942 | 8/1983 |
| EP | 0214571 | 1/1989 |
| EP | 0358338 | 3/1990 |
| EP | 0167751 | 7/1990 |
| EP | 0410497 | 1/1991 |
| EP | 0575244 | 12/1993 |
| EP | 0493507 | 4/1994 |
| EP | 0713541 | 5/1997 |
| EP | 0713540 | 3/1998 |
| EP | 0815293 | 5/1999 |
| EP | 0902844 | 9/2000 |
| EP | 0880410 | 11/2004 |
| EP | 1404894 | 4/2005 |
| EP | 1002644 | 3/2007 |
| EP | 1658392 | 3/2007 |
| EP | 1870489 | 12/2007 |
| EP | 1027170 | 11/2008 |
| EP | 1972461 | 8/2009 |
| EP | 2243863 | 10/2010 |
| EP | 1550740 | 3/2011 |
| EP | 1918419 | 2/2013 |
| EP | 2296829 | 2/2013 |
| EP | 1863952 | 3/2013 |
| EP | 2044239 | 9/2014 |
| GB | 2241963 | 9/1991 |
| GB | 2259920 | 3/1993 |
| JP | 04193997 | 7/1992 |
| JP | 2002030461 | 1/2002 |
| JP | 2003201576 | 7/2003 |
| JP | 2004183015 | 7/2004 |
| JP | 2004263252 | 9/2004 |
| JP | 3784400 | 6/2006 |
| JP | 2007177314 | 7/2007 |
| JP | 2007327090 | 12/2007 |
| JP | 2009280887 | 12/2009 |
| JP | 2009280889 | 12/2009 |
| JP | 2011001623 | 1/2011 |
| JP | 2011032512 | 2/2011 |
| JP | 2011067737 | 4/2011 |
| JP | 2011157586 | 8/2011 |
| JP | 5186644 | 4/2013 |
| KR | 20140001700 | 1/2014 |
| WO | 1993020260 | 10/1993 |
| WO | 1994001517 | 1/1994 |
| WO | 1995002660 | 1/1995 |
| WO | 1995033869 | 12/1995 |
| WO | 1997013588 | 4/1997 |
| WO | 1997014822 | 4/1997 |
| WO | 1999067029 | 12/1999 |
| WO | 2001006035 | 1/2001 |
| WO | 2001032952 | 5/2001 |
| WO | 2002031064 | 4/2002 |
| WO | 2002031065 | 4/2002 |
| WO | 2002031222 | 4/2002 |
| WO | WO-03083171 | 10/2003 |
| WO | 2004046421 | 6/2004 |
| WO | 2004063291 | 7/2004 |
| WO | 2005001158 | 1/2005 |
| WO | 2006043727 | 4/2006 |
| WO | 2006126394 | 11/2006 |
| WO | 2007061011 | 5/2007 |
| WO | 2008064091 | 5/2008 |
| WO | 2009045845 | 4/2009 |
| WO | 2011029680 | 3/2011 |
| WO | 2011044099 | 4/2011 |
| WO | 2011093282 | 8/2011 |
| WO | 2012104430 | 8/2012 |
| WO | 2012134179 | 10/2012 |
| WO | 2013019303 | 2/2013 |
| WO | 2014022004 | 2/2014 |
| WO | 2014032779 | 3/2014 |
| WO | 2014037088 | 3/2014 |

* cited by examiner

TREATED SUBSTRATES

CROSS-REFERENCE TO RELATED APPLICATION

This application is a division of U.S. patent application Ser. No. 16/566,010, filed on Sep. 10, 2019, which will issue as U.S. Pat. No. 11,591,707 on Feb. 28, 2023, which is a division of U.S. patent application Ser. No. 14/880,552, filed on Oct. 12, 2015, now U.S. Pat. No. 10,435,806.

FIELD OF THE INVENTION

The present invention relates to the use of electrodeposition to provide coatings on metal substrates.

BACKGROUND OF THE INVENTION

The use of protective coatings on metal substrates for improved corrosion resistance and paint adhesion is common. Conventional techniques for coating such substrates include techniques that involve pretreating the metal substrate with chromium-containing compositions. The use of such chromate-containing compositions, however, imparts environmental and health concerns.

As a result, chromate-free pretreatment compositions have been developed. Such compositions are generally based on chemical mixtures that react with the substrate surface and bind to it to form a protective layer. For example, pretreatment compositions based on a Group IIIB or IVB metal compound have become more prevalent. Such compositions often contain a source of free fluoride, i.e., fluoride available as isolated ions in the pretreatment composition as opposed to fluoride that is bound to another element, such as the Group IIIB or IVB metal. Free fluoride can etch the surface of the metal substrate, thereby promoting deposition of a Group IIIB or IVB metal coating. Nevertheless, the corrosion resistance capability of these pretreatment compositions has generally been significantly inferior to conventional chromium-containing pretreatments.

It would be desirable to provide methods for treating a metal substrate that overcome at least some of the previously described drawbacks of the prior art, including the environmental drawbacks associated with the use of chromates. It also would be desirable to provide methods for treating metal substrate that impart corrosion resistance properties that are equivalent to, or even superior to, the corrosion resistance properties imparted through the use of phosphate- or chromium-containing conversion coatings. It would also be desirable to provide related coated metal substrates.

SUMMARY OF THE INVENTION

The present invention is directed to a method for treating a substrate comprising: deoxidizing at least a portion of the substrate; and passing electric current between an anode and the substrate that has been deoxidized, serving as a cathode, said cathode and anode being immersed in an electrodepositable pretreatment composition comprising a lanthanide series element and/or a Group IIIB metal, an oxidizing agent, a metal-complexing agent, and a surfactant to deposit a coating from the electrodepositable pretreatment composition onto a surface of the substrate.

The present invention also is directed to a method for treating a substrate comprising: deoxidizing at least a portion of the substrate; passing electric current between an anode and the substrate that has been deoxidized, serving as a cathode, said cathode and anode being immersed in an electrodepositable pretreatment composition comprising a lanthanide series element and/or a Group IIIB metal, an oxidizing agent, and a metal-complexing agent, to deposit a coating from the electrodepositable pretreatment composition onto a surface of the substrate; and contacting at least a portion of the substrate that has the coating electrodeposited from the pretreatment composition with a sealing composition comprising phosphate and a Group IIIB and/or IVB metal.

The present invention also is directed to a method for treating a substrate comprising: deoxidizing at least a portion of the substrate; contacting at least a portion of the substrate that has been deoxidized with a spontaneously depositable pretreatment composition comprising a Group IIIB and/or IVB metal; and passing electric current between an anode and the substrate that has been contacted with the spontaneously depositable pretreatment composition, serving as a cathode, said cathode and anode being immersed in an electrodepositable pretreatment composition comprising a lanthanide series element and/or a Group IIIB metal, an oxidizing agent, and a metal-complexing agent, to deposit a coating from the electrodepositable pretreatment composition onto a surface of the substrate.

Substrates treated according to the methods of the present invention also are disclosed.

DETAILED DESCRIPTION

For purposes of the following detailed description, it is to be understood that the invention may assume various alternative variations and step sequences, except where expressly specified to the contrary. Moreover, other than in any operating examples, or where otherwise indicated, all numbers such as those expressing values, amounts, percentages, ranges, subranges and fractions may be read as if prefaced by the word "about," even if the term does not expressly appear. Accordingly, unless indicated to the contrary, the numerical parameters set forth in the following specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques. Where a closed or open-ended numerical range is described herein, all numbers, values, amounts, percentages, subranges and fractions within or encompassed by the numerical range are to be considered as being specifically included in and belonging to the original disclosure of this application as if these numbers, values, amounts, percentages, subranges and fractions had been explicitly written out in their entirety.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

As used herein, unless indicated otherwise, a plural term can encompass its singular counterpart and vice versa, unless indicated otherwise. For example, although reference is made herein to "a" deoxidizing solution, "a" pretreatment composition, and "a" metal-complexing agent, a combination (i.e., a plurality) of these components can be used. In addition, in this application, the use of "or" means "and/or" unless specifically stated otherwise, even though "and/or" may be explicitly used in certain instances.

As used herein, "including," "containing" and like terms are understood in the context of this application to be synonymous with "comprising" and are therefore open-ended and do not exclude the presence of additional undescribed and/or unrecited elements, materials, ingredients and/or method steps. As used herein, "consisting of" is understood in the context of this application to exclude the presence of any unspecified element, ingredient and/or method step. As used herein, "consisting essentially of" is understood in the context of this application to include the specified elements, materials, ingredients and/or method steps "and those that do not materially affect the basic and novel characteristic(s)" of what is being described.

As used herein, the terms "on," "onto," "applied on," "applied onto," "formed on," "deposited on," "deposited onto," mean formed, overlaid, deposited, and/or provided on but not necessarily in contact with the surface. For example, a coating layer "formed over" a substrate does not preclude the presence of one or more other intervening coating layers of the same or different composition located between the formed coating layer and the substrate.

As used herein, "spontaneously depositable pretreatment composition" refers to a composition that is capable of reacting with and chemically altering the substrate surface and binding to it to form a protective layer in the absence of an externally applied voltage.

As used herein, an "electrodepositable pretreatment composition" refers to a composition containing a non-elemental metal, i.e., a metal-containing compound, complex, ion or the like wherein the metal is not in elemental form, that is capable of reacting with and chemically altering the substrate surface and binding to it to form a protective layer upon the introduction of an externally applied voltage.

As used herein, a "sealing composition" refers to a composition, e.g., a solution or dispersion, that affects a material deposited onto a substrate in such a way as to alter its physical and/or chemical properties.

As used herein, the term "Group IA metal" refers to an element that is in Group IA of the CAS version of the Periodic Table of the Elements as is shown, for example, in the Handbook of Chemistry and Physics, 63$^{rd}$ edition (1983), corresponding to Group 1 in the actual IUPAC numbering.

As used herein, the term "Group IA metal compound" refers to compounds that include at least one element that is in Group IA of the CAS version of the Periodic Table of the Elements.

As used herein, the term "Group IIIB metal" refers to yttrium and scandium of the CAS version of the Periodic Table of the Elements as is shown, for example, in the Handbook of Chemistry and Physics, 63$^{rd}$ edition (1983), corresponding to Group 3 in the actual IUPAC numbering. For clarity, "Group IIIB metal" expressly excludes lanthanide series elements.

As used herein, the term "Group IIIB metal compound" refers to compounds that include at least one element that is in group IIIB of the CAS version of the Periodic Table of the Elements as defined above.

As used herein, the term "Group IVB metal" refers to an element that is in group IVB of the CAS version of the Periodic Table of the Elements as is shown, for example, in the Handbook of Chemistry and Physics, 63$^{rd}$ edition (1983), corresponding to Group 4 in the actual IUPAC numbering.

As used herein, the term "Group IVB metal compound" refers to compounds that include at least one element that is in Group IVB of the CAS version of the Periodic Table of the Elements.

As used herein, the term "lanthanide series elements" refers to elements 57-71 of the CAS version of the Periodic Table of the Elements and includes elemental versions of the lanthanide series elements. In embodiments, the lanthanide series elements may be those which have both common oxidation states of +3 and +4, referred to hereinafter as +3/+4 oxidation states.

As used herein, the term "lanthanide compound" refers to compounds that include at least one of elements 57-71 of the CAS version of the Periodic Table of the Elements.

As used herein, the term "aluminum," when used in reference to a substrate, refers to substrates made of or comprising aluminum and/or aluminum alloy, and clad aluminum substrates.

As used herein, the term "oxidizing agent," when used with respect to a component of the electrodepositable pretreatment composition, refers to a chemical which is capable of oxidizing at least one of: a metal present in the substrate which is contacted by the electrodepositable pretreatment composition, a lanthanide series element present in the electrodepositable pretreatment composition, and/or a metal-complexing agent present in the electrodepositable pretreatment composition. As used herein with respect to "oxidizing agent," the phrase "capable of oxidizing" means capable of removing electrons from an atom or a molecule present in the substrate or the electrodepositable pretreatment composition, as the case may be, thereby decreasing the number of electrons of such atom or molecule.

Unless otherwise disclosed herein, as used herein, the terms "total composition weight", "total weight of a composition" or similar terms refer to the total weight of all ingredients being present in the respective composition including any carriers and solvents.

Unless otherwise disclosed herein, as used herein, the term "substantially free" means that a particular material is not purposefully added to a composition, and, if present at all, only is present in a composition and/or layers comprising the same in a trace amount of 1 ppm or less, based on a total weight of the composition or layer(s), as the case may be. As used herein, unless otherwise disclosed, the term "completely free" means that a particular material is present in a composition and/or layers comprising the same in an amount of 1 ppb or less, based on a total weight of the composition or layer(s), as the case may be.

As mentioned above, the present invention is directed to a method for treating a substrate comprising: deoxidizing at least a portion of the substrate; and passing electric current between an anode and the substrate that has been deoxidized, serving as a cathode, the cathode and anode being immersed in an electrodepositable pretreatment composition comprising a lanthanide series element and/or a Group IIIB metal, an oxidizing agent, a metal-complexing agent, and optionally a surfactant to deposit a coating from the electrodepositable pretreatment composition onto a surface of the substrate. According to the present invention, optionally the deoxidized substrate may be contacted with a spontaneously depositable pretreatment composition comprising a Group IIIB and/or IVB metal prior to immersion in the electrodepositable pretreatment composition. According to the present invention, following electrodeposition of the electrodepositable pretreatment composition, the substrate optionally may be contacted with a sealing composition comprising phosphate.

As previously mentioned, the present disclosure is directed to methods for treating a variety of substrates. Suitable substrates that may be used in the methods of the present invention include metal substrates, metal alloy substrates, and/or substrates that have been metallized, such as nickel-plated plastic. According to the present invention, the metal or metal alloy can comprise or be steel, aluminum, and/or magnesium. For example, the steel substrate could be cold rolled steel, electrogalvanized steel, and/or hot dipped galvanized steel. Aluminum alloys of the 2XXX, 5XXX, 6XXX, or 7XXX series as well as clad aluminum alloys also may be used as the substrate. Magnesium alloys of the AZ31B, AZ91C, AM60B, or EV31A series also may be used as the substrate. The substrate used in the present invention may also comprise titanium and/or titanium alloys. According to the present invention, the substrate may comprise a portion of a vehicle such as a vehicular body (e.g., without limitation, door, body panel, trunk deck lid, roof panel, hood, roof and/or stringers, rivets, landing gear components, and/or skins used on an aircraft) and/or a vehicular frame. As used herein, "vehicle" or variations thereof includes, but is not limited to, civilian, commercial and military aircraft, and/or land vehicles such as cars, motorcycles, and/or trucks.

The metal substrate to be treated in accordance with the methods of the present invention may first be cleaned to remove grease, dirt, and/or other extraneous matter. At least a portion of the surface of the substrate may be cleaned by physical and/or chemical means, such as mechanically abrading the surface and/or cleaning/degreasing the surface with commercially available alkaline or acidic cleaning agents that are well known to those skilled in the art. Examples of alkaline cleaners suitable for use in the present invention include Chemkleen™ 163, 177, 611L, and 490MX, each of which is commercially available from PPG Industries, Inc., and Turco 4215 NC-LT and Ridoline 298, each of which is commercially available from Henkel AG & Co.

Following the cleaning step, the substrate may be rinsed with tap water, deionized water, and/or an aqueous solution of rinsing agents in order to remove any residue. According to the present invention, the wet substrate surface may be deoxidized (described below), or the substrate may be dried prior to deoxidizing the substrate surface, such as air dried, for example, by using an air knife, by flashing off the water by brief exposure of the substrate to a high temperature or by passing the substrate between squeegee rolls.

According to the present invention, at least a portion of the cleaned substrate surface may be deoxidized, mechanically and/or chemically. As used herein, the term "deoxidize" means removal of the oxide layer found on the surface of the substrate in order to promote uniform deposition of the pretreatment composition (described below), as well as to promote the adhesion of the pretreatment composition coating to the substrate surface. Suitable deoxidizers will be familiar to those skilled in the art. A typical mechanical deoxidizer may be uniform roughening of the substrate surface, such as by using a scouring or cleaning pad. Typical chemical deoxidizers include, for example, acid-based deoxidizers such as phosphoric acid, nitric acid, fluoroboric acid, sulfuric acid, chromic acid, hydrofluoric acid, and ammonium bifluoride, or Amchem 7/17 deoxidizers (available from Henkel Technologies, Madison Heights, MI), OAKITE DEOXIDIZER LNC (commercially available from Chemetall), TURCO DEOXIDIZER 6 (commercially available from Henkel), or combinations thereof. Often, the chemical deoxidizer comprises a carrier, often an aqueous medium, so that the deoxidizer may be in the form of a solution or dispersion in the carrier, in which case the solution or dispersion may be brought into contact with the substrate by any of a variety of known techniques, such as dipping or immersion, spraying, intermittent spraying, dipping followed by spraying, spraying followed by dipping, brushing, or roll-coating. According to the present invention, the skilled artisan will select a temperature range of the solution or dispersion, when applied to the metal substrate, based on etch rates, for example, at a temperature ranging from 50° F. to 150° F. (10° C. to 66° C.), such as from 70° F. to 130° F. (21° C. to 54° C.), such as from 80° F. to 120° F. (27° C. to 49° C.). The contact time may be from 30 seconds to 20 minutes, such as 1 minute to 15 minutes, such as 90 seconds to 12 minutes, such as 3 minutes to 9 minutes.

Following the deoxidizing step, the substrate optionally may be rinsed with tap water, deionized water, or an aqueous solution of rinsing agents, and optionally may be dried as described above.

According to the present invention, the deoxidized substrate may be contacted by an electrodepositable pretreatment composition comprising a lanthanide series element and/or a Group IIIB metal, an oxidizing agent, and a metal-complexing agent, to electrolytically deposit a coating from the electrodepositable pretreatment composition onto a surface of the substrate. In the process of electrodeposition, an anode and the metal substrate being treated, serving as a cathode, are placed in the electrodepositable pretreatment composition. Upon passage of an electric current between the cathode and the anode while they are in contact with the electrodepositable pretreatment composition, a layer will form on the surface of the substrate from the electrodepositable pretreatment composition which serves to protect the underlying substrate. As mentioned above, the electrodeposition step may include immersing the electroconductive substrate into an electrodeposition bath of an aqueous electrodepositable pretreatment composition, the substrate serving as a cathode in an electrical circuit comprising the cathode and an anode. Sufficient electrical current is applied between the electrodes to deposit a film of the electrodepositable pretreatment coating composition onto or over at least a portion of the surface of the electroconductive substrate, e.g., covering at least 75% of the substrate surface which was immersed into the electrodepositable pretreatment composition, such as at least 85% of the substrate surface, such as at least 95% of the substrate surface. Also, it should be understood that as used herein, an electrodepositable pretreatment composition or coating formed "over" at least a portion of a "substrate" refers to a composition formed directly on at least a portion of the substrate surface, as well as a composition or coating formed over any coating or pretreatment material which was previously applied to at least a portion of the substrate. According to the present invention, electrodeposition is usually carried out at a current density of from 0.5 mAmps/cm$^2$ of substrate to 50 mAmps/cm$^2$ of substrate, such as from 1 mAmps/cm$^2$ of substrate to 20 mAmps/cm$^2$ of substrate, such as from 2 mAmps/cm$^2$ of substrate to 10 mAmps/cm$^2$ of substrate. One skilled in the art of electrodeposition will understand the amperage and voltage requirements necessary to achieve the disclosed range of current density. According to the present invention, the electrodepositable pretreatment composition may be applied under a constantly applied power. Alternatively, according to the present invention, the electrodepositable pretreatment composition may be applied with a pulsing power. As used herein with respect to application of the electrodepositable pretreatment composition, "pulsing" means cycling between a "current on" and a "current off" condition at a range of frequencies known to one of ordinary skill in the art of electrodeposition.

As mentioned above, according to the present invention, the electrodepositable pretreatment composition may comprise a lanthanide series element and/or a Group IIIB metal. According to the present invention, the lanthanide series element may, for example, comprise cerium, praseodymium, terbium, or combinations thereof and the Group IIIB metal may comprise yttrium, scandium, or combinations thereof.

According to the present invention, the lanthanide series element and/or Group IIIB metal (calculated on elemental metal) may be present in the electrodepositable pretreatment composition in an amount of at least 0.01%, based on total composition weight, such as at least 0.10%, such as at least 0.20%. According to the present invention, the lanthanide series element and/or Group IIIB metal (calculated on elemental metal) may be present in the electrodepositable pretreatment composition in an amount of no more than 10%, based on total composition weight, such as no more than 5%, such as no more than 2.5%. According to the present invention, the lanthanide series element and/or Group IIIB metal (calculated on elemental metal) may be present in the electrodepositable pretreatment composition in amounts of from 0.01% to 10%, based on total composition weight, such as from 0.10% to 5%, such as from 0.20% to 2.5%.

As mentioned above, according to the present invention, the electrodepositable pretreatment composition also may comprise an oxidizing agent. Non-limiting examples of the oxidizing agent include peroxides, persulfates, perchlorates, hypochlorite, nitric acid, sparged oxygen, bromates, peroxibenzoates, ozone, or combinations thereof.

As mentioned above, according to the present invention, the electrodepositable pretreatment composition also may comprise an oxidizing agent. Non-limiting examples of the oxidizing agent include peroxides, persulfates, perchlorates, permanganates, hypochlorite, nitric acid, sparged oxygen, bromates, peroxi-benzoates, ozone, or combinations thereof.

The oxidizing agent may be present in the electrodepositable pretreatment composition in an amount of at least 0.01%, based on total composition weight, such as at least 0.05%, such as at least 0.10%. The oxidizing agent may be present in the electrodepositable pretreatment composition in an amount of no more than 10%, based on total composition weight, such as no more than 7.0%, such as no more than 5.0%. The oxidizing agent may be present in the electrodepositable pretreatment composition in amounts of from 0.01% to 10%, based on total composition weight, such as from 0.05% to 7.0%, such as from 0.10% to 5.0%.

As mentioned above, the electrodepositable pretreatment composition also may comprise a metal-complexing agent. As used herein, the term "metal-complexing agent" means a compound capable of forming at least one coordinate bond with a metal atom or ion. Non-limiting examples of the metal-complexing agent include gelatin and/or amino acids, such as pigskin gelatin, proline, hydroxyproline, glycine, arginine, or combinations thereof.

The metal-complexing agent may be present in the electrodepositable pretreatment composition in an amount of at least 0.01%, based on total composition weight, such as at least 0.05%, such as at least 0.10%. The metal-complexing agent may be present in the electrodepositable pretreatment composition in an amount of no more than 10%, based on total composition weight, such as no more than 5.0%, such as no more than 2.0%. The metal-complexing agent may be present in the electrodepositable pretreatment composition in amounts of from 0.01% to 10%, based on total composition weight, such as from 0.05% to 5%, such as from 0.10% to 2%.

According to the present invention, the electrodepositable pretreatment composition may further comprise a cationic, amphoteric, or nonionic surfactant. Exemplary nonionic surfactants that may be used include nonylphenol ethoxylate or an octylphenol ethoxylate, such as Triton™X-100, available from Dow Chemical Corporation, or an ethoxylated alcohol, such as Tomadol 1-9, available from Air Products. Exemplary cationic surfactants that may be used include quaternary amines, such as Tomamine Q-14-2, available from Air Products.

The surfactant may be present in the electrodepositable pretreatment composition in an amount of at least 0.001%, based on total composition weight, such as at least 0.005%, such as at least 0.01%. The surfactant may be present in the electrodepositable pretreatment composition in an amount of no more than 5.0%, based on total composition weight, such as no more than 1.0%, such as no more than 0.50%. The surfactant may be present in the electrodepositable pretreatment composition in amounts of from 0.001% to 5.0%, based on total composition weight, such as from 0.005% to 1.0%, such as from 0.01% to 0.50%.

Often, the electrolytically depositable pretreatment composition comprises a carrier, often an aqueous medium, so that the electrolytically depositable pretreatment composition may be in the form of a solution or dispersion of a lanthanide and/or Group IIIB metal compound in the carrier.

According to the present invention, the electrolytically depositable pretreatment composition also may further comprise a resinous binder. Suitable resins include reaction products of one or more alkanolamines and an epoxy-functional material containing at least two epoxy groups, such as those disclosed in U.S. Pat. No. 5,653,823. In some cases, such resins contain beta hydroxy ester, imide, or sulfide functionality, incorporated by using dimethylolpropionic acid, phthalimide, or mercaptoglycerine as an additional reactant in the preparation of the resin. Alternatively, the reaction product is that of the diglycidyl ether of Bisphenol A (commercially available, e.g., from Shell Chemical Company as EPON 880), dimethylol propionic acid, and diethanolamine in a 0.6 to 5.0:0.05 to 5.5:1 mole ratio. Other suitable resinous binders include water soluble and water dispersible polyacrylic acids such as those as disclosed in U.S. Pat. Nos. 3,912,548 and 5,328,525; phenol formaldehyde resins such as those as described in U.S. Pat. No. 5,662,746; water soluble polyamides such as those disclosed in WO 95/33869; copolymers of maleic or acrylic acid with allyl ether such as those as described in Canadian patent application 2,087,352; and water soluble and dispersible resins including epoxy resins, aminoplasts, phenol-formaldehyde resins, tannins, and polyvinyl phenols such as those as discussed in U.S. Pat. No. 5,449,415.

According to the present invention, the pH of the electrodepositable pretreatment composition may range from 1.0 to 4.0, such as from 1.7 to 3.0, and may be adjusted using, for example, any acid and/or base as is necessary. According to the present invention, the pH of the composition may be maintained through the inclusion of an acidic material, including water soluble and/or water dispersible acids, such as nitric acid, sulfuric acid, and/or phosphoric acid. According to the present invention, the pH of the composition may be maintained through the inclusion of a basic material, including water soluble and/or water dispersible bases, such as sodium hydroxide, sodium carbonate, potassium hydroxide, ammonium hydroxide, ammonia, and/or amines such as triethylamine, methylethyl amine, or mixtures thereof. According to the present invention, the solution or dispersion, when applied to the metal substrate, may be at a temperature ranging from 60° F. to 200° F. (15° C. to 93° C.), such as from 70° F. to 180° F. (21° C. to 82° C.), such as from 80° F. to 150° F. (27° C. to 66° C.).

According to the present invention, the thickness of the electrodepositable pretreatment coating formed from the electrodepositable pretreatment composition may be less than 1 micrometer, for example, from 250 nanometers to 600 nanometers.

According to the present invention, following deposition of a coating from the electrodepositable pretreatment compositions in the electrodepositing pretreatment step, the substrate may be rinsed with tap water, deionized water, and/or an aqueous solution of rinsing agents in order to remove any residue as described above. Optionally, the substrate may be dried as described above.

Optionally, following deposition of a coating from the electrodepositable pretreatment composition, the method of treating the substrate may further comprise sealing the electrodeposited pretreatment coating by contacting the substrate with a sealing composition comprising phosphate, such as a Group IA metal phosphate, including, for example, sodium phosphates, lithium phosphates, potassium phosphates, or combinations thereof. Such phosphates include monophosphates, diphosphates, polyphosphates, or combinations thereof and may be anhydrous or hydrated.

According to the present invention, the phosphate may be present in the sealing composition in an amount of at least 0.05%, based on total weight of the sealing composition, such as at least 0.10%, such as at least 0.5%. According to the present invention, the phosphate may be present in the sealing composition in an amount of no more than 15%, based on total weight of the sealing composition, such as no more than 10%, such as no more than 5%. According to the present invention, the phosphate may be present in the sealing composition in an amount of from 0.05% to 15%, based on total weight of the sealing composition, such as from 0.10% to 10%, such as from 0.5% to 5.0%.

According to the present invention, the Group IA metal may be present in the sealing composition in an amount of at least 0.001%, based on total weight of the sealing composition, such as at least 0.01%, such as at least 0.05%. According to the present invention, the Group IA metal may be present in the sealing composition in an amount of no more than 5.0%, based on total weight of the sealing composition, such as no more than 2.5%, such as no more than 1.0%. According to the present invention, the Group IA metal may be present in the sealing composition in an amount of 0.001% to 5.0%, based on total weight of the sealing composition, such as from 0.01% to 2.5%, such as from 0.05% to 1.0%.

According to the present invention, the sealing solution may further comprise a Group IIIB and/or IVB metal. Where applicable, the metal itself may be used. Alternatively, a Group IIIB and/or IVB metal compound may be used. For example, the Group IIIB and/or IVB metal compound used in the sealing solution may be a compound of zirconium, titanium, hafnium, yttrium, scandium, or a mixture thereof. Suitable compounds of zirconium include, but are not limited to, hexafluorozirconic acid, alkali metal and ammonium salts thereof, ammonium zirconium carbonate, zirconyl nitrate, zirconyl sulfate, zirconium carboxylates and zirconium hydroxy carboxylates, such as zirconium acetate, zirconium oxalate, ammonium zirconium glycolate, ammonium zirconium lactate, ammonium zirconium citrate, and mixtures thereof. Suitable compounds of titanium include, but are not limited to, fluorotitanic acid and its salts. A suitable compound of hafnium includes, but is not limited to, hafnium nitrate. A suitable compound of yttrium includes, but is not limited to, yttrium nitrate.

According to the present invention, the Group IIIB and/or IVB metal compound may be present in the sealing composition in an amount of at least 1 ppm metal, such as at least 3 ppm metal, or, in some cases, at least 5 ppm metal (calculated as elemental metal), based on total weight of the sealing composition. According to the present invention, the Group IIIB and/or IVB metal compound may be present in the sealing composition in an amount of no more than 100 ppm metal, such as no more than 50 ppm metal, or, in some cases, no more than 20 ppm metal (calculated as elemental metal), based on total weight of the sealing composition. According to the present invention, the Group IIIB and/or IVB metal compound may be present in the sealing composition in an amount of from 1 ppm metal to 100 ppm metal (calculated as elemental metal), based on total weight of the sealing composition, such as from 3 ppm metal to 50 ppm metal, such as from 5 ppm metal to 20 ppm metal.

Often, the sealing composition comprises a carrier, often an aqueous medium, so that the sealing composition may be in the form of a solution or dispersion in the carrier such that the solution or dispersion may be brought into contact with the substrate by any of a variety of known techniques, such as dipping or immersion, spraying, intermittent spraying, dipping followed by spraying, spraying followed by dipping, brushing, or roll-coating. The solution or dispersion of the present invention may have a pH of from 1 to 6.5, such as from 2 to 5.5 such as 3 to 4.5. The solution or dispersion, when applied to the metal substrate, may be at a temperature ranging from 50° F. to 200° F. (10° C. to 93° C.), such as from 70° F. to 180° F. (21° C. to 82° C.), such as from 80° F. to 150° F. (27° C. to 66° C.). The contact time may be from 60 seconds to 60 minutes, such as 3 minutes to 20 minutes, such as 4 minutes to 15 minutes.

According to the present invention, optionally the substrate may be contacted with a spontaneously depositable pretreatment composition prior to passing the electric current between the substrate and the anode to deposit a coating from the electrodepositable pretreatment composition onto the substrate. The spontaneously depositable pretreatment composition is different from the electrodepositable pretreatment composition and may comprise a Group IIIB metal, a Group IVB metal, or combinations thereof.

Often, the spontaneously depositable pretreatment composition comprises a carrier, often an aqueous medium, so that the spontaneously depositable pretreatment composition may be in the form of a solution or dispersion of a Group IIIB and/or Group IVB metal compound in the carrier. The solution or dispersion may be brought into contact with the substrate by any of a variety of known techniques, such as dipping or immersion, spraying, intermittent spraying, dipping followed by spraying, spraying followed by dipping, brushing, or roll-coating. According to the present invention, the solution or dispersion, when applied to the metal substrate, may be at a temperature ranging from 50° F. to 200° F. (10° C. to 93° C.), such as from 70° F. to 180° F. (21° C. to 82° C.), such as from 80° F. to 150° F. (27° C. to 66° C.). According to the present invention, often, the amount of time that the spontaneously depositable pretreatment composition may be in contact with the substrate may be from 30 seconds to ten minutes, such as 1 minute to 10 minutes, such as from 90 seconds to 5 minutes.

As mentioned above, the spontaneously depositable pretreatment composition may comprise a Group IIIB metal, a Group IVB metal, or combinations thereof. Where applicable, the metal itself, i.e., the metal in an elemental form, may be used. Alternatively, a Group IIIB and/or IVB metal compound may be used. For example, the Group IIIB and/or IVB metal compound used in the spontaneously deposited pretreatment composition may be a compound of zirconium, titanium, hafnium, yttrium, scandium, or a mixture thereof. Suitable compounds of zirconium include, but are not limited to, hexafluorozirconic acid, alkali metal and ammonium salts thereof, ammonium zirconium carbonate, zirconyl nitrate, zirconyl sulfate, zirconium carboxylates and zirconium hydroxy carboxylates, such as zirconium acetate, zirconium oxalate, ammonium zirconium glycolate, ammonium zirconium lactate, ammonium zirconium citrate, and mixtures thereof. Suitable compounds of titanium include, but are not limited to, fluorotitanic acid and its salts. A suitable compound of hafnium includes, but is not limited to, hafnium nitrate. Suitable compounds of yttrium include, but are not limited to, yttrium halides.

According to the present invention, the Group IIIB and/or Group IVB metal compound may be present in the spontaneously depositable pretreatment composition in an amount of at least 10 ppm metal, such as at least 20 ppm metal, at least 30 ppm metal, or, in some cases, at least 50 ppm metal (calculated as elemental metal), based on total weight of the spontaneously depositable pretreatment composition. According to the present invention, the Group IIIB and/or IVB metal compound may be present in the spontaneously depositable pretreatment composition in an amount of no more than 500 ppm metal, such as no more than 300 ppm metal, or, in some cases, no more than 200 ppm metal (calculated as elemental metal), based on total weight of the spontaneously depositable pretreatment composition. According to the present invention, the Group IIIB and/or IVB metal compound may be present in the spontaneously depositable pretreatment composition in an amount of 10 ppm metal to 500 ppm metal (calculated as elemental metal), such as from 20 ppm metal to 300 ppm metal, such as from 50 ppm metal to 200 ppm metal), based on total weight of the spontaneously depositable pretreatment composition.

According to the present invention, the spontaneously depositable pretreatment also may comprise an electropositive metal ion. As used herein, the term "electropositive metal ion" refers to metal ions that will be reduced by the metal substrate being treated when the spontaneously depositable pretreatment solution contacts the surface of the metallic substrate. As will be appreciated by one skilled in the art, the tendency of chemical species to be reduced is called the reduction potential, is expressed in volts, and is measured relative to the standard hydrogen electrode, which is arbitrarily assigned a reduction potential of zero. The reduction potential for several elements is set forth in Table 1 below (according to the CRC 82$^{nd}$ Edition, 2001-2002). An element or ion is more easily reduced than another element or ion if it has a voltage value, E*, in the following table, that is more positive than the elements or ions to which it is being compared.

TABLE 1

| Element | Reduction half-cell reaction | Voltage, E* |
|---|---|---|
| Potassium | $K^+ + e \rightarrow K$ | −2.93 |
| Calcium | $Ca^{2+} + 2e \rightarrow Ca$ | −2.87 |
| Sodium | $Na^+ + e \rightarrow Na$ | −2.71 |
| Magnesium | $Mg^{2+} + 2e \rightarrow Mg$ | −2.37 |

TABLE 1-continued

| Element | Reduction half-cell reaction | Voltage, E* |
|---|---|---|
| Aluminum | $Al^{3+} + 3e \rightarrow Al$ | −1.66 |
| Zinc | $Zn^{2+} + 2e \rightarrow Zn$ | −0.76 |
| Iron | $Fe^{2+} + 2e \rightarrow Fe$ | −0.45 |
| Nickel | $Ni^{2+} + 2e \rightarrow Ni$ | −0.26 |
| Tin | $Sn^{2+} + 2e \rightarrow Sn$ | −0.14 |
| Lead | $Pb^{2+} + 2e \rightarrow Pb$ | −0.13 |
| Hydrogen | $2H^+ + 2e \rightarrow H_2$ | −0.00 |
| Copper | $Cu^{2+} + 2e \rightarrow Cu$ | 0.34 |
| Mercury | $Hg_2^{2+} + 2e \rightarrow 2Hg$ | 0.80 |
| Silver | $Ag^+ + e \rightarrow Ag$ | 0.80 |
| Gold | $Au^{3+} + 3e \rightarrow Au$ | 1.50 |

Thus, as will be apparent, when the metal substrate comprises one of the materials listed earlier, such as cold rolled steel, hot rolled steel, steel coated with zinc metal, zinc compounds, or zinc alloys, hot-dipped galvanized steel, galvanealed steel, steel plated with zinc alloy, aluminum alloys, aluminum plated steel, aluminum alloy plated steel, magnesium and magnesium alloys, suitable electropositive metals for deposition thereon include, for example, nickel, copper, silver, and gold, as well mixtures thereof.

According to the present invention, when the electropositive metal comprises copper, both soluble and insoluble compounds may serve as the source of copper in the spontaneously depositable pretreatment compositions. For example, the supplying source of copper ions in the spontaneously depositable pretreatment composition may be a water-soluble copper compound. Specific examples of such compounds include, but are not limited to, copper cyanide, copper potassium cyanide, copper sulfate, copper nitrate, copper pyrophosphate, copper thiocyanate, disodium copper ethylenediaminetetraacetate tetrahydrate, copper bromide, copper oxide, copper hydroxide, copper chloride, copper fluoride, copper gluconate, copper citrate, copper lauroyl sarcosinate, copper formate, copper acetate, copper propionate, copper butyrate, copper lactate, copper oxalate, copper phytate, copper tartrate, copper malate, copper succinate, copper malonate, copper maleate, copper benzoate, copper salicylate, copper aspartate, copper glutamate, copper fumarate, copper glycerophosphate, sodium copper chlorophyllin, copper fluorosilicate, copper fluoroborate and copper iodate, as well as copper salts of carboxylic acids in the homologous series formic acid to decanoic acid, copper salts of polybasic acids in the series oxalic acid to suberic acid, and copper salts of hydroxycarboxylic acids, including glycolic, lactic, tartaric, malic and citric acids.

When copper ions supplied from such a water-soluble copper compound are precipitated as an impurity in the form of copper sulfate, copper oxide, etc., it may be desirable to add a complexing agent that suppresses the precipitation of copper ions, thus stabilizing them as a copper complex in the composition.

According to the present invention, the copper compound may be added as a copper complex salt such as $K_3Cu(CN)_4$ or Cu-EDTA, which can be present stably in the spontaneously depositable pretreatment composition on its own, but it is also possible to form a copper complex that can be present stably in the spontaneously depositable pretreatment composition by combining a complexing agent with a compound that is difficult to solubilize on its own. Examples thereof include a copper cyanide complex formed by a combination of CuCN and KCN or a combination of CuSCN and KSCN or KCN, and a Cu-EDTA complex formed by a combination of $CuSO_4$ and EDTA•2Na.

With regard to the complexing agent, a compound that can form a complex with copper ions can be used; examples thereof include inorganic compounds such as cyanide compounds and thiocyanate compounds, and polycarboxylic acids, and specific examples thereof include ethylenediaminetetraacetic acid, salts of ethylenediaminetetraacetic acid such as dihydrogen disodium ethylenediaminetetraacetate dihydrate, aminocarboxylic acids such as nitrilotriacetic acid and iminodiacetic acid, oxycarboxylic acids such as citric acid and tartaric acid, succinic acid, oxalic acid, ethylenediaminetetramethylenephosphonic acid, and glycine.

According to the present invention, the electropositive metal may be present in the spontaneously depositable pretreatment composition in an amount of at least 1 ppm (calculated as elemental metal), based on the total weight of the spontaneously depositable pretreatment composition, such as at least 5 ppm, such as at least 35 ppm, such as at least 50 ppm. According to the present invention, the electropositive metal may be present in the spontaneously depositable pretreatment composition in an amount of no more than 100 ppm (calculated as elemental metal), based on the total weight of the spontaneously depositable pretreatment composition, such as no more than 80 ppm, such as no more than 40 ppm, such as no more than 10 ppm.

According to the present invention, the electropositive metal may be present in the spontaneously depositable pretreatment composition in an amount of from 1 ppm to 100 ppm (calculated as elemental metal), based on the total weight of the spontaneously depositable pretreatment composition, such as from 5 ppm to 80 ppm, such as from 35 ppm to 80 ppm. The amount of electropositive metal in the spontaneously depositable pretreatment composition can range between the recited values inclusive of the recited values.

According to the present invention, the pH of the spontaneously depositable pretreatment composition may range from 1 to 6, such as from 2 to 5.5, and may be adjusted using, for example, any acid and/or base as is necessary. According to the present invention, the pH of the composition may be maintained through the inclusion of an acidic material, including water soluble and/or water dispersible acids, such as nitric acid, sulfuric acid, and/or phosphoric acid. According to the present invention, the pH of the composition may be maintained through the inclusion of a basic material, including water soluble and/or water dispersible bases, such as sodium hydroxide, sodium carbonate, potassium hydroxide, ammonium hydroxide, ammonia, and/or amines such as triethylamine, methylethyl amine, or mixtures thereof.

According to the present invention, the spontaneously depositable pretreatment composition also may further comprise a resinous binder. Suitable resins include reaction products of one or more alkanolamines and an epoxy-functional material containing at least two epoxy groups, such as those disclosed in U.S. Pat. No. 5,653,823. In some cases, such resins contain beta hydroxy ester, imide, or sulfide functionality, incorporated by using dimethylolpropionic acid, phthalimide, or mercaptoglycerine as an additional reactant in the preparation of the resin. Alternatively, the reaction product is that of the diglycidyl ether of Bisphenol A (commercially available, e.g., from Shell Chemical Company as EPON 880), dimethylol propionic acid, and diethanolamine in a 0.6 to 5.0:0.05 to 5.5:1 mole ratio. Other suitable resinous binders include water soluble and water dispersible polyacrylic acids such as those disclosed in U.S. Pat. Nos. 3,912,548 and 5,328,525; phenol formaldehyde resins such as those described in U.S. Pat. No. 5,662,746; water soluble polyamides such as those disclosed in WO 95/33869; copolymers of maleic or acrylic acid with allyl ether such as those described in Canadian patent application 2,087,352; and water soluble and dispersible resins including epoxy resins, aminoplasts, phenol-formaldehyde resins, tannins, and polyvinyl phenols such as those discussed in U.S. Pat. No. 5,449,415.

According to the present invention, the resinous binder often may be present in the spontaneously depositable pretreatment composition in an amount of 0.005 percent to 30 percent by weight, such as 0.5 to 3 percent by weight, based on the total weight of the composition. Alternatively, according to the present invention, the spontaneously depositable pretreatment composition may be substantially free or, in some cases, completely free of any resinous binder. As used herein, the term "substantially free", when used with reference to the absence of resinous binder in the spontaneously depositable pretreatment composition, means that, if present at all, any resinous binder is present in the spontaneously depositable pretreatment composition in a trace amount of less than 0.005 percent by weight, based on total weight of the composition. As used herein, the term "completely free" means that there is no resinous binder in the spontaneously depositable pretreatment composition at all.

The spontaneously depositable pretreatment composition may comprise an aqueous medium and may optionally contain other materials such as nonionic surfactants and auxiliaries conventionally used in the art of pretreatment. In the aqueous medium, water dispersible organic solvents, for example, alcohols with up to about 8 carbon atoms such as methanol, isopropanol, and the like, may be present; or glycol ethers such as the monoalkyl ethers of ethylene glycol, diethylene glycol, or propylene glycol, and the like. When present, water dispersible organic solvents are typically used in amounts up to about ten percent by volume, based on the total volume of aqueous medium.

Other optional materials include surfactants that function as defoamers or substrate wetting agents. Anionic, cationic, amphoteric, and/or nonionic surfactants may be used. Defoaming surfactants may optionally be present at levels up to 1 weight percent, such as up to 0.1 percent by weight, and wetting agents are typically present at levels up to 2 percent, such as up to 0.5 percent by weight, based on the total weight of the spontaneously depositable pretreatment composition.

According to the present invention, the spontaneously depositable pretreatment composition optionally also may comprise a silane, such as, for example, an amino group-containing silane coupling agent, a hydrolysate thereof, or a polymer thereof, such as those described in United States Patent Application Publication No. 2004/0163736 A1 at [0025] to [0031], the cited portion of which being incorporated herein by reference, such as a compound having at least an amino group and having a siloxane linkage in a molecule. Containing at least one kind selected from the group consisting of amino group-containing silane coupling agents, hydrolysates thereof and polymers thereof enables the spontaneously depositable pretreatment composition to act on both of a chemical conversion coat and a coating film, and adhesion between both coats may be improved.

According to the present invention, the amino group-containing silane coupling agent of the spontaneously depositable pretreatment composition is not particularly limited, and examples thereof may include publicly known silane coupling agents such as N-2(aminoethyl)3-aminopropylmethyldimethox-ysilane, N-2(aminoethyl)3-aminopropyltrimethoxysilane, N-2(aminoethyl)3-aminopropyltriethoxysilane, 3-aminopropyltrimethoxysilan-e, 3-aminopropyltriethoxysilane, 3-triethoxysilyl-N-(1,3-dimethyl-butylide-ne)propylamine, N-phenyl-3-aminopropyltrimethoxysilane and N,N-bis[3-(trimethoxysilyl)propyl]ethylenediamine. KBM-602, KBM-603, KBE-603, KBM-903, KBE-9103 and KBM-573 (each manufactured by Shin-Etsu Chemical Co., Ltd.) and XS 1003 (manufactured by Chisso Co., Ltd.), which are commercially available amino group-containing silane coupling agents, may also be used.

According to the present invention, the hydrolysate of the above amino group-containing silane coupling agent can be produced by a publicly known method, for example, a method of dissolving the amino group-containing silane coupling agent in ion-exchanged water to adjust the solution to be acidic with any acid. As the hydrolysate of the amino group-containing silane coupling agent, commercially available products such as KBP-90 (manufactured by Shin-Etsu Chemical Co., Ltd., effective ingredient: 32%) may also be used.

According to the present invention, the polymer of the above amino group-containing silane coupling agent of the spontaneously depositable pretreatment composition is not particularly limited, and examples thereof may include commercially available products such as Sila-Ace S-330 (.gamma.-aminopropyltriethoxysilane; manufactured by Chisso Co., Ltd.), Sila-Ace S-320 (N-(2-aminoethyl)-3-aminopropyltrimethoxysilane; manufactured by Chisso Co., Ltd.) and the like.

According to the present invention, the blending amount of at least one kind selected from the group consisting of amino group-containing silane coupling agents, hydrolysates thereof and polymers thereof in the spontaneously depositable pretreatment composition may be at least 5 ppm as a concentration of solid matter, such as at least 10 ppm, such as at least 50 ppm, and in some cases may be no more than 5000 ppm as a concentration of solid matter, such as no more than 1000, such as no more than 500. According to the present invention, the blending amount of at least one kind selected from the group consisting of amino group-containing silane coupling agents, hydrolysates thereof and polymers thereof in the spontaneously depositable pretreatment composition may be from 5 ppm to 5000 ppm as a concentration of solid matter, such as from 10 ppm to 500 ppm, such as from 50 ppm to 1000 ppm. Alternatively, according to the present invention, the spontaneously depositable pretreatment composition may be substantially free, or, in some cases, completely free, of any such amino group-containing silane coupling agent. As used herein, the term "substantially free", when used with reference to the absence of amino-group containing silane coupling agent in the spontaneously depositable pretreatment composition, means that, if present at all, any amino-group containing silane coupling agent, hydrolysate thereof, or polymer thereof that is present in the spontaneously depositable pretreatment composition is present in a trace amount of less than 5 ppm, based on total weight of the spontaneously depositable pretreatment composition. As used herein, the term "completely free" means that there is no amino-group containing silane coupling agent, hydrolysate thereof, or polymer thereof in the spontaneously depositable pretreatment composition at all.

According to the present invention, the spontaneously depositable pretreatment composition may further comprise a reaction accelerator, such as nitrite ions, nitro-group containing compounds, hydroxylamine sulfate, persulfate ions, sulfite ions, hyposulfite ions, peroxides, iron (III) ions, citric acid iron compounds, bromate ions, perchlorinate ions, chlorate ions, chlorite ions as well as ascorbic acid, citric acid, tartaric acid, malonic acid, succinic acid and salts thereof. Specific examples of suitable materials and their amounts are described in United States Patent Application Publication No. 2004/0163736 A1 at [0032] to [0041], the cited portion of which being incorporated herein by reference. By blending these chemical conversion reaction accelerators in the spontaneously depositable pretreatment composition of the present invention, unbalanced coat-precipitation is adjusted and good chemical conversion coat having no unevenness in an edge portion and a flat portion of a material can be attained.

According to the present invention, when present, a supply source of the nitrite ion of the reaction accelerator of the spontaneously depositable pretreatment composition is not particularly limited, and examples thereof include sodium nitrite, potassium nitrite, ammonium nitrite and the like. The nitro group-containing compound is not particularly limited, and examples thereof include nitrobenzenesulfonic acid, nitroguanidine and the like. A supply source of the persulfate ion is not particularly limited, and examples thereof include $Na_2S_2O_8$, $K_2S_2O_8$ and the like.

According to the present invention, when present, a supply source of the sulfite ion of the reaction accelerator of the spontaneously depositable pretreatment composition is not particularly limited, and examples thereof include sodium sulfite, potassium sulfite, ammonium sulfite and the like. A supply source of the hyposulfite ion is not particularly limited, and examples thereof include sodium hyposulfite, potassium hyposulfite, ammonium hyposulfite and the like. The peroxides are not particularly limited, and examples thereof include hydrogen peroxide, sodium peroxide, potassium peroxide and the like.

According to the present invention, when present, a supply source of the iron (III) ion of the reaction accelerator of the spontaneously depositable pretreatment composition is not particularly limited, and examples thereof include ferric nitrate, ferric sulfate, ferric chloride and the like. The citric acid iron compound is not particularly limited, and examples thereof include citric acid iron ammonium, citric acid iron sodium, citric acid iron potassium and the like. A supply source of the bromate ion is not particularly limited, and examples thereof include sodium bromate, potassium bromate, ammonium bromate and the like. A supply source of the perchlorinate ion is not particularly limited, and examples thereof include sodium perchlorinate, potassium perchlorinate, ammonium perchlorinate and the like.

According to the present invention, when present, a supply source of the chlorite ion of the reaction accelerator of the spontaneously depositable pretreatment composition is not particularly limited, and examples thereof include sodium chlorate, potassium chlorate, ammonium chlorate and the like. A supply source of the chlorite ion is not particularly limited, and examples thereof include sodium chlorite, potassium chlorite, ammonium chlorite and the like. The ascorbic acid and salt thereof are not particularly limited, and examples thereof include ascorbic acid, sodium ascorbate, potassium ascorbate, ammonium ascorbate and the like. The citric acid and salt thereof are not particularly limited, and examples thereof include citric acid, sodium citrate, potassium citrate, ammonium citrate and the like. The tartaric acid and salt thereof are not particularly limited, and examples thereof include tartaric acid, ammonium tartrate, potassium tartrate, sodium tartrate and the like. The malonic acid and salt thereof are not particularly limited, and examples thereof include malonic acid, ammonium malonate, potassium malonate, sodium malonate and the like. The succinic acid and salt thereof are not particularly limited, and examples thereof include succinic acid, sodium succinate, potassium succinate, ammonium succinate and the like.

When present, according to the present invention, the above-described chemical conversion reaction accelerators may be used alone or in combination of two or more kinds of components as required. A blending amount of the chemical conversion reaction accelerator in the spontaneously depositable pretreatment composition of the present invention may be at least 1 ppm based on total weight of the spontaneously depositable pretreatment composition, such as at least 3 ppm, such as at least 5 ppm, and in some cases may be no more than 5000 ppm based on total weight of the spontaneously depositable pretreatment composition, such as no more than 2000 ppm, such as no more than 1500 ppm. According to the present invention, a blending amount of the chemical conversion reaction accelerator in the spontaneously depositable pretreatment composition may be from 1 ppm to 5000 ppm based on total weight of the spontaneously depositable pretreatment composition, such as from 3 ppm to 2000 ppm, such as from 5 ppm to 1500 ppm. According to the present invention, the spontaneously depositable pretreatment composition and/or the bath containing the spontaneously depositable pretreatment composition may further comprise free fluoride. As will be appreciated, the source of free fluoride in the spontaneously depositable pretreatment composition can vary. For example, in some cases, the free fluoride may derive from the Group IIIB and/or IVB metal compound used in the spontaneously depositable pretreatment composition, such as is the case, for example, with hexafluorozirconic acid, or may derive from sources other than the Group IIIB and/or IVB metal compound, such as, for example, HF, $NH_4F$, $NH_4HF_2$, NaF, and $NaHF_2$. As used herein, the term "free fluoride" refers to isolated fluoride or bifluoride ions and its concentration in the spontaneously depositable pretreatment composition and/or the bath containing the spontaneously depositable pretreatment composition can be measured using a variety of methods familiar to those skilled in the art. Frequently, fluoride ion concentration is measured using an ion-selective electrode ("ISE"), such as the sympHony® Fluoride Ion Selective Combination Electrode supplied by VWR International, or similar electrodes. The fluoride ISE is standardized by immersing the electrode into solutions of known fluoride concentration and recording the reading in millivolts; then, plotting these millivolt readings in a logarithmic graph. The millivolt reading of an unknown sample can then be compared to this calibration graph and the concentration of fluoride determined. Alternatively, the fluoride ISE can be used with a meter that will perform the calibration calculations internally and thus, after calibration, the concentration of the unknown sample can be read directly.

Fluoride ion is a small negative ion with a high charge density, so in aqueous solution it is frequently complexed with metal ions having a high positive charge density, such as zirconium or titanium, or with hydrogen ion. The fluoride ions thus complexed are not measurable with the fluoride ISE unless the solution they are present in is mixed with an ionic strength adjustment buffer that releases the fluoride ions from such complexes. At that point the fluoride ions are measurable by the fluoride ISE, and the measurement is known as "total fluoride". A fluoride measurement taken without using such a reagent is known as "free fluoride", since it is only the fluoride ion not bound with hydrogen ion or in metal complexes.

If left unchecked, the level of free fluoride in the bath containing the spontaneously depositable pretreatment composition may increase with time as substrate is pretreated with the spontaneously depositable pretreatment composition. Accordingly, a metal which forms a fluoride salt having a $pK_{sp}$ of at least 11 may be added to the bath containing the spontaneously depositable pretreatment composition, as disclosed at column 6, line 11 to column 7, line 20 in U.S. Pat. No. 8,673,091, incorporated herein by reference.

Optionally, according to the present invention, the spontaneously depositable pretreatment composition may further comprise a source of phosphate ions. For example, phosphate ions may be present in an amount of greater than 10 ppm up to 60 ppm, such as for example from 20 ppm to 40 ppm or for example 30 ppm, based on total weight of the spontaneously depositable pretreatment composition.

Alternatively, according to the present invention, the spontaneously depositable pretreatment composition may, in some instances, exclude phosphate ions or phosphate-containing compounds and/or the formation of sludge, such as aluminum phosphate, iron phosphate, and/or zinc phosphate, formed in the case of using a treating agent based on zinc phosphate. As used herein, "phosphate-containing compounds" include compounds containing the element phosphorous such as ortho phosphate, pyrophosphate, metaphosphate, tripolyphosphate, and the like, and can include, but are not limited to, monovalent, divalent, or trivalent cations such as: sodium, potassium, calcium, zinc, nickel, manganese, aluminum and/or iron. When a coating composition and/or a coating comprising the same is substantially free, essentially free, or completely free of phosphate, this includes phosphate ions or compounds containing phosphate in any form.

Thus, according to the present invention, the electrodepositable and/or the spontaneously depositable pretreatment composition and/or layers deposited from the same may be substantially free, or in some cases may be essentially free, or in some cases may be completely free, of one or more of any of the ions or compounds listed in the preceding paragraph. A pretreatment composition and/or layers deposited from the same that is substantially free of phosphate means that phosphate ions or compounds containing phosphate are not intentionally added, but may be present in trace amounts, such as because of impurities or unavoidable contamination from the environment. In other words, the amount of material is so small that it does not affect the properties of the composition; this may further include that phosphate is not present in the pretreatment compositions and/or layers deposited from the same in such a level that they cause a burden on the environment. The term "substantially free" means that the pretreatment compositions and/or layers deposited from the same contain less than 10 ppm of any or all of the phosphate anions or compounds listed in the preceding paragraph, based on total weight of the composition or the layer, respectively, if any at all. The term "essentially free" means that the pretreatment compositions and/or layers comprising the same contain less than 1 ppm of any or all of the phosphate anions or compounds listed in the preceding paragraph. The term "completely free" means that the pretreatment compositions and/or layers comprising the same contain less than 1 ppb of any or all of the phosphate anions or compounds listed in the preceding paragraph, if any at all.

According to the present invention, the electrodepositable and/or the spontaneously depositable pretreatment composition may exclude chromium or chromium-containing compounds. As used herein, the term "chromium-containing compound" refers to materials that include hexavalent chromium. Non-limiting examples of such materials include chromic acid, chromium trioxide, chromic acid anhydride, dichromate salts, such as ammonium dichromate, sodium dichromate, potassium dichromate, and calcium, barium, magnesium, zinc, cadmium, and strontium dichromate. When a pretreatment composition and/or a coating or a layer, respectively, deposited from the same is substantially free, essentially free, or completely free of chromium, this includes chromium in any form, such as, but not limited to, the hexavalent chromium-containing compounds listed above.

Thus, optionally, according to the present invention, the present pretreatment compositions and/or coatings or layers, respectively, deposited from the same may be substantially free, may be essentially free, and/or may be completely free of one or more of any of the elements or compounds listed in the preceding paragraph. A pretreatment composition and/or coating or layer, respectively, deposited from the same that is substantially free of chromium or derivatives thereof means that chromium or derivatives thereof are not intentionally added, but may be present in trace amounts, such as because of impurities or unavoidable contamination from the environment. In other words, the amount of material is so small that it does not affect the properties of the pretreatment composition; in the case of chromium, this may further include that the element or compounds thereof are not present in the pretreatment compositions and/or coatings or layers, respectively, deposited from the same in such a level that it causes a burden on the environment. The term "substantially free" means that the pretreatment compositions and/or coating or layers, respectively, deposited from the same contain less than 10 ppm of any or all of the elements or compounds listed in the preceding paragraph, based on total weight of the composition or the layer, respectively, if any at all. The term "essentially free" means that the pretreatment compositions and/or coatings or layers, respectively, deposited from the same contain less than 1 ppm of any or all of the elements or compounds listed in the preceding paragraph, if any at all. The term "completely free" means that the pretreatment compositions and/or coatings or layers, respectively, deposited from the same contain less than 1 ppb of any or all of the elements or compounds listed in the preceding paragraph, if any at all.

According to the present invention, the thickness of the spontaneously deposited pretreatment coating may be less than 1 micrometer, for example from 1 to 500 nanometers, or from 10 to 300 nanometers.

Following the contacting with the spontaneously depositable pretreatment composition, the substrate may be rinsed with deionized water and/or an aqueous solution of rinsing agents in order to remove any residue. The substrate may be dried, for example air dried, for example, by using an air knife, by flashing off the water by brief exposure of the substrate to a high temperature or by passing the substrate between squeegee rolls.

The present invention will now be illustrated by the following specific, non-limiting examples.

EXAMPLES

In each of the following Examples, the panel served as the cathode and stainless steel served as the counter-electrode.

Cleaning compositions A and B for cleaning panels were prepared from the ingredients shown in Table 2, added in the order shown while stirring at room temperature until thoroughly blended:

TABLE 2

Cleaners

| | Examples | |
|---|---|---|
| | A | B |
| Turco 4215 NC-LT[1], grams | 50 | — |
| Ridoline 298 (R-298)[2], parts by volume | — | 100 |
| deionized water, grams | 950 | — |
| tap water, parts by volume | — | 900 |

[1]An alkaline cleaner commercially available from Henkel AG & Co.

[2]An alkaline cleaner commercially available from Henkel AG & Co.

Deoxidizing compositions for treating panels were prepared from the ingredients shown in Table 3, added in the order shown while stirring at room temperature until thoroughly blended:

TABLE 3

Deoxidizing Solutions

| | Examples | |
|---|---|---|
| | C | D |
| deionized water, grams | 990 | — |
| tap water, parts by volume | — | 850 |
| sulfuric acid, 97%, grams | 10 | — |
| Deoxidizer 6/16 (Deox 6/16)[3], parts by volume | — | 50 |
| nitric acid, 69%, parts by volume | — | 100 |

[3]Commercially available from Henkel AG & Co.

The spontaneously depositable pretreatment composition for treating panels was prepared from the ingredients shown in Table 4, added in the order shown while stirring at room temperature until thoroughly blended:

TABLE 4

Spontaneously Depositable Pretreatment Composition

| | Example E |
|---|---|
| deionized water, grams | 3785 |
| fluorozirconic acid, 45%, grams | 3.5 |
| phosphoric acid, 85%, grams | 0.06 |
| Chemfil Buffer[4], grams | adjust pH to 4.45 (~10 grams) |

[4]Commercially available from PPG Industries, Inc.

The electrodepositable pretreatment compositions were prepared from the ingredients shown in Table 5 as described below:

TABLE 5

| Electrodepositable Pretreatment Compositions | Examples | | | |
|---|---|---|---|---|
| | F | G | H | I |
| Metal Nitrate Solution | | | | |
| cerium nitrate hexahydrate $[Ce(NO_3)_3 \bullet 6H_2O]$, 75%, grams | 25.6 | 25.6 | 25.6 | 25.6 |
| yttrium nitrate $[Y(NO_3)_3]$, grams | — | — | — | 12.6 |
| deionized water, grams | 1600.0 | 1600.0 | 1600.0 | 1600.0 |
| Gelatin Solution | | | | |
| gelatin, grams | 5.6 | 5.6 | 5.6 | 5.6 |
| deionized water, grams | 320.6 | 320.6 | 320.6 | 320.6 |
| $H_2O_2$ solution | | | | |
| (35% in deionized water), grams of solution | 91.2 | 22.8 | 22.8 | 22.8 |
| Surfactant solution | | | | |
| (10% Triton X-100[5]), grams of solution | — | — | 10.0 | 10.0 |

[5]A non-ionic surfactant available from The Dow Chemical Company.

In Examples F-I, cerium nitrate and/or yttrium nitrate were added to 1600 g DI water and stirred until fully dissolved. The metal nitrate solution was adjusted to pH=2.7 using a 10% nitric acid solution. In a separate glass beaker, the gelatin solution shown in Table 5 was prepared by heating below 38° C. until dissolved. Next, the gelatin solution was slowly added to the metal nitrate solution while stirring. Then, hydrogen peroxide was added to the gelatin/metal nitrate solution while stirring. In Examples H and I, surfactant was then added to the solution while stirring.

Phosphate-containing sealing compositions were prepared as shown in Table 6:

TABLE 6

| Phosphate Seal Compositions | Examples | | |
|---|---|---|---|
| | J | K | L |
| sodium phosphate, monobasic dihydrate, 99%, grams | 25.0 | 19.0 | — |
| lithium phosphate, 99%, grams | — | — | 19.0 |
| deionized water, grams | 975.0 | 881.0 | 881.0 |
| Example E, grams | — | 50.0 | 50.0 |

In Examples J-K, the phosphate was fully dissolved in DI water at ambient temperature. In Examples K and L, the fluorozirconic acid (FZA) solution of Example E was added to the phosphate solution.

Comparative Example 1

Aluminum 2024T3 bare substrate was hand-wiped with methyl ethyl ketone and a disposable cloth prior to chemical cleaning and allowed to air dry. The panel was immersed, with agitation, in the cleaner solution of Example A for 5 minutes at 55° C. After cleaning, the panel received a 30 second cascading deionized water rinse. The panel was then immersed in the deoxidizing solution of Example C for 10 minutes at 50° C., followed by a cascading deionized water rinse for 30 seconds. The panel was then immersed in the electrodepositable pretreatment solution of Example F at ambient temperature while a potential of 10 volts was applied for approximately 180 seconds. A current density of 2.0-5.0 mA/cm2 was targeted. A Xantrex XFR 300-4 power supply was used during the deposition process. The panel was then rinsed with deionized water before immersion in a phosphate seal bath of Example J for 5 minutes at 85° C. After immersion in the seal bath, the panel was rinsed with deionized water and air dried.

Comparative Example 2

Aluminum 2024T3 bare substrate was hand-wiped with methyl ethyl ketone and a disposable cloth prior to chemical cleaning and was air dried. The panel was immersed, with agitation, in the cleaner solution of Example B for 2 minutes at 55° C. After cleaning, the panel was immersed, with agitation, in a tap water rinse for 1 minute at ambient temperature. The panel was then rinsed with cascading tap water for 30 seconds. The panel was then immersed in the deoxidizing solution of Example D for 2 minutes at ambient temperature, followed by immersion in a tap water rinse for 1 minute. The panel was then rinsed with cascading tap water for 30 seconds. The panel was then immersed in the electrodepositable pretreatment solution of Example G at ambient temperature while a potential of 5-15 volts was applied for approximately 90 seconds. The panel was then rinsed with deionized water. A current density of 4.0-6.0 mA/cm2 was targeted. A Xantrex XFR 300-4 power supply was used during the deposition process. The panel was then rinsed with deionized water before immersion in a phosphate seal bath of Example J for 5 minutes at 85° C. After immersion in the phosphate seal bath, the panel was rinsed with deionized water and air dried.

Comparative Example 3

Aluminum 2024T3 bare substrate was hand-wiped with methyl ethyl ketone and a disposable cloth prior to chemical cleaning and was air dried. The panel was immersed, with agitation, in the cleaner solution of Example B for 2 minutes at 55° C. After cleaning, the panel was immersed, with agitation, in a tap water rinse for 1 minute at ambient temperature. The panel was then rinsed with cascading tap water for 30 seconds. The panel was then immersed in the deoxidizing solution of Example D for 2 minutes at ambient temperature, followed by immersion in a tap water rinse for 1 minute. The panel was then rinsed with cascading tap water for 30 seconds. The panel was then immersed in the electrodepositable pretreatment solution of Example G at ambient temperature while a potential of 5-15 volts was applied for 15-20 seconds. The panel was then rinsed with deionized water. The pretreatment/rinse cycle was repeated four additional times. A current density of 4.0-6.0 mA/cm2 was targeted. A Xantrex XFR 300-4 power supply was used during the deposition process. The panel was then rinsed with deionized water before immersion in a phosphate seal bath of Example J for 5 minutes at 85° C. After immersion in the phosphate seal bath, the panel was rinsed with deionized water and air dried.

Example 4

Aluminum 2024T3 bare substrate was hand-wiped with methyl ethyl ketone and a disposable cloth prior to chemical cleaning and was air dried. The panel was immersed, with agitation, in the cleaner solution of Example B for 2 minutes at 55° C. After cleaning, the panel was immersed, with agitation, in a tap water rinse for 1 minute at ambient temperature. The panel was then rinsed with cascading tap water for 30 seconds. The panel was then immersed in the deoxidizing solution of Example D for 2 minutes at ambient temperature, followed by immersion in tap water rinse for 1 minute. The panel was then rinsed with cascading tap water for 30 seconds. The panel was then immersed in the fluorozirconic acid containing spontaneously depositable pretreatment composition of Example E for 3 minutes at ambient temperature followed by a cascading deionized water rinse for 30 seconds. The panel was then immersed in the electrodepositable pretreatment solution of Example G at ambient temperature while a potential of 5-15 volts was cycled on/off five times, with each cycle consisting of 10-15 seconds on and 5-10 seconds off, and each cycle being followed by a deionized water rinse. A current density of 4.0-6.0 mA/cm2 was targeted. A Xantrex XFR 300-4 power supply was used during the deposition process. The panel was then rinsed with deionized water before immersion in a phosphate seal bath of Example J for 5 minutes at 85° C. After immersion in the phosphate seal bath, the panel was rinsed with deionized water and air dried.

Example 5

Aluminum 2024T3 bare substrate was hand-wiped with methyl ethyl ketone and a disposable cloth prior to chemical cleaning and was air dried. The panel was immersed, with agitation, in the cleaner solution of Example B for 2 minutes at 55° C. After cleaning, the panel was immersed, with agitation, in a tap water rinse for 1 minute at ambient temperature. The panel was then rinsed with cascading tap water for 30 seconds. The panel was then immersed in the deoxidizing solution of Example D for 2 minutes at ambient temperature, followed by immersion in a tap water rinse for 1 minute. The panel was then rinsed with cascading tap water for 30 seconds. The panel was then immersed in the electrodepositable pretreatment solution of Example G at ambient temperature while a potential of 5-15 volts was cycled on/off five times, each cycle consisting of 10-15 seconds on and 5-10 seconds off with a deionized water rinse between each cycle. A current density of 4.0-6.0 mA/cm2 was targeted. A Xantrex XFR 300-4 power supply was used during the deposition process. The panel was then rinsed with deionized water before immersion in a phosphate seal/fluorozirconic acid bath of Example K for 5 minutes at 85° C. After immersion in the phosphate seal/fluorozirconic acid bath, the panel was rinsed with deionized water and air dried.

Example 6

Aluminum 2024T3 bare substrate was hand-wiped with methyl ethyl ketone and a disposable cloth prior to chemical cleaning and air dried. The panel was immersed, with agitation, in the cleaner solution of Example B for 2 minutes at 55° C. After cleaning, the panel was immersed, with agitation, in a tap water rinse for 1 minute at ambient temperature. The panel was then rinsed with cascading tap water for 30 seconds. The panel was then immersed in the deoxidizing solution of Example D for 2 minutes at ambient temperature, followed by immersion in a tap water rinse for 1 minute. The panel was then rinsed with cascading tap water for 30 seconds. The panel was then immersed in the fluorozirconic acid containing spontaneously depositable pretreatment composition of Example E for 3 minutes at ambient temperature followed by a cascading deionized rinse for 30 seconds. The panel was then immersed in the electrodepositable pretreatment solution of Example G at ambient temperature while a potential of 5-15 volts was cycled on/off five times, each cycle consisting of 10-15 seconds on and 5-10 seconds off with a deionized water rinse between each cycle. A current density of 4.0-6.0 mA/cm2 was targeted. A Xantrex XFR 300-4 power supply was used during the deposition process. The panel was then rinsed with deionized water before immersion in a phosphate seal/fluorozirconic acid bath of Example K for 5 minutes at 85° C. After immersion in the bath of Example K, the panel was rinsed with deionized water and air dried.

Example 7

Aluminum 2024T3 bare substrate was hand-wiped with methyl ethyl ketone and a disposable cloth prior to chemical cleaning and was air dried. The panel was immersed, with agitation, in the cleaner solution of Example B for 2 minutes at 55° C. After cleaning, the panel was immersed, with agitation, in a tap water rinse for 1 minute at ambient temperature. The panel was then rinsed with cascading tap water for 30 seconds. The panel was then immersed in the deoxidizing solution of Example D for 2 minutes at ambient temperature, followed by immersion in a tap water rinse for 1 minute. The panel was then rinsed with cascading tap water for 30 seconds. The panel was then immersed in the electrodepositable pretreatment solution of Example H at ambient temperature while a potential of 5-15 volts was cycled on/off five times, each cycle consisting of 10-15 seconds on and 5-10 seconds off with the panel remaining in the bath. A current density of 4.0-6.0 mA/cm2 was targeted. A Xantrex XFR 300-4 power supply was used during the deposition process. The panel was then rinsed with deionized water before immersion in the phosphate seal bath of Example J for 5 minutes at 85° C. After immersion in the bath of Example J, the panel was rinsed with deionized water and air dried.

Example 8

Aluminum 2024T3 bare substrate was hand-wiped with methyl ethyl ketone and a disposable cloth prior to chemical cleaning and was air dried. The panel was immersed, with agitation, in the cleaner solution of Example B for 2 minutes at 55° C. After cleaning, the panel was immersed, with agitation, in a tap water rinse for 1 minute at ambient temperature. The panel was then rinsed with cascading tap water for 30 seconds with the panel remaining in the baths. The panel was then immersed in the deoxidizing solution of Example D for 2 minutes at ambient temperature, followed by immersion in a tap water rinse for 1 minute. The panel was then rinsed with cascading tap water for 30 seconds with the panel remaining in the bath. The panel was then immersed in the fluorozirconic acid containing spontaneously depositable pretreatment composition of Example E for 3 minutes at ambient temperature followed by a cascading deionized rinse for 30 seconds with the panel remaining in the bath. The panel was then immersed in the electrodepositable pretreatment solution of Example I at ambient temperature while a potential of 5-15 volts was cycled on/off five times, each cycle consisting of 10-15 seconds on and 5-10 seconds off with the panel remaining in the bath. A current density of 4.0-6.0 mA/cm2 was targeted. A Xantrex XFR 300-4 power supply was used during the deposition process. The panel was then rinsed with deionized water before immersion in the phosphate seal/fluorozirconic acid bath of Example K for 5 minutes at 85° C. After immersion in the bath of Example K, the panel was rinsed with deionized water and air dried.

Example 9

Aluminum 2024T3 bare substrate was hand-wiped with methyl ethyl ketone and a disposable cloth prior to chemical cleaning and was air dried. The panel was immersed, with agitation, in the cleaner solution of Example B for 2 minutes at 55° C. After cleaning, the panel was immersed, with agitation, in a tap water rinse for 1 minute at ambient temperature. The panel was then rinsed with cascading tap water for 30 seconds with the panel remaining in the bath. The panel was then immersed in the deoxidizing solution of Example D for 2 minutes at ambient temperature, followed by immersion in a tap water rinse for 1 minute. The panel was then rinsed with cascading tap water for 30 seconds with the panel remaining in the bath. The panel was then immersed in the fluorozirconic acid containing spontaneously depositable pretreatment composition of Example E for 3 minutes at ambient temperature followed by a cascading deionized rinse for 30 seconds with the panel remaining in the baths. The panel was then immersed in the electrodepositable pretreatment solution of Example H at ambient temperature while a potential of 5-15 volts was cycled on/off five times, each cycle consisting of 10-15 seconds on and 5-10 seconds off with the panel remaining in the bath. A current density of 4.0-6.0 mA/cm2 was targeted. A Xantrex XFR 300-4 power supply was used during the deposition process. The panel was then rinsed with deionized water before immersion in the phosphate seal/fluorozirconic acid bath of Example L for 5 minutes at 85° C. After immersion in the bath of Example L, the panel was rinsed with deionized water and air dried.

Example 10

Aluminum 2024T3 bare substrate was hand-wiped with methyl ethyl ketone and a disposable cloth prior to chemical cleaning and was air dried. The panel was immersed, with agitation, in the cleaner solution of Example B for 2 minutes at 55° C. After cleaning, the panel was immersed, with agitation, in a tap water rinse for 1 minute at ambient temperature. The panel was then rinsed with cascading tap water for 30 seconds with the panel remaining in the baths. The panel was then immersed in the deoxidizing solution of Example D for 2 minutes at ambient temperature, followed by immersion in a tap water rinse for 1 minute. The panel was then rinsed with cascading tap water for 30 seconds with the panel remaining in the baths. The panel was then immersed in the fluorozirconic acid containing spontaneously depositable pretreatment composition of Example E for 3 minutes at ambient temperature followed by a cascading deionized rinse for 30 seconds with the panel remaining in the baths. The panel was then immersed in the electrodepositable pretreatment solution of Example I at ambient temperature while a potential of 5-15 volts was cycled on/off five times, each cycle consisting of 10-15 seconds on and 5-10 seconds off with the panel remaining in the bath. A current density of 4.0-6.0 mA/cm2 was targeted. A Xantrex XFR 300-4 power supply was used during the deposition process. The panel was then rinsed with deionized water before immersion in a phosphate seal/fluorozirconic acid bath of Example L for 5 minutes at 85° C. After immersion in the bath of Example L, the panel was rinsed with deionized water and air dried.

Salt Spray Tests

Panels pretreated with pretreatment compositions as described in examples 1-10 were exposed to salt spray cabinets according to ASTM B117 for 168 hours. Panels were removed, rinsed with deionized water, allowed to dry under ambient conditions for 1 hour and were rated according to the rating scale shown in Table 7. Data are shown in Table 8.

TABLE 7

Rating Scale
Salt Spray Rating Scale
(1 side, per 3" × 10" panel or equivalent surface area)

| Rating | Description |
|---|---|
| 10 | identical to how they went into test/no corrosion |
| 9 | no "countable" pits (if there is a pit, it's either from an edge, scratch, pre-existing, etc.) |
| 8 | <5 pits |
| 7 | ≥5 pits and ≤15 pits |
| 6 | >15 pits and ≤40 pits |
| 5 | >40 pits or ≤50% of the surface area is corroded |
| 4 | >50% of the surface area is corroded |
| 3 | >70% of the surface area is corroded |
| 2 | >85% of the surface area is corroded |
| 1 | 100% of the surface area is corroded |

Note:
Pits must have a salt tail to be counted

TABLE 8

Salt Spray Ratings

| Example | Rating |
|---|---|
| 1 (Comparative) | 4 |
| 2 (Comparative) | 5 |
| 3 (Comparative) | 5 |
| 4 | 6 |
| 5 | NA |
| 6 | 6 |
| 7 | 5 |
| 8 | 7 |
| 9 | 6 |
| 10 | 6 |

Adhesion Tests

Using an air atomized spray gun, commercially available CA7502 spray primer (PPG Industries, Inc.) was applied to the test panels of Comparative Examples 2 and 3 and Examples 4, and 5 approximately 24 hours after the pretreatment was applied. The primed test panels were allowed to cure at ambient conditions for 7 days before testing. Adhesion testing was performed by first scoring, with a razor, a grid of 100 squares each measuring 2 $mm^2$. Each cut was deep enough to penetrate through the coating and pretreatment layers to the substrate. Next, a piece of filament tape (Scotch #898) was firmly pressed over the area then quickly pulled perpendicularly from the surface. The performance was rated based on the percentage of primer remaining on the panel within the grid. Wet adhesion was performed similarly with the panel soaking in deionized water for 7 days at ambient temperature and then dried prior to adhesion testing. Data are shown in Table 9.

TABLE 9

| Adhesion | | | | |
|---|---|---|---|---|
| Example | FZA | Dry Film Thickness (μm) | Dry Rating | Wet Rating |
| Comparative Example 3 | n/a | 1.25 | 85 | 0 |
| Example 4 | Before electrolytic pretreatment composition | 1.24 | 95 | 0 |
| Example 5 | Included in phosphate seal composition | 1.11 | 75 | 80 |
| Example 6 | Before electrolytic pretreatment composition and included in phosphate seal | 1.24 | 95 | 90 |

As illustrated in Table 9, inclusion of FZA before cerium pretreatment had no pronounced effect on adhesion compared to the Comparative Example 3. Inclusion of FZA after cerium pretreatment in phosphate seal solution improved adhesion relative to Comparative Example 3. Inclusion of FZA before and after cerium pretreatment in phosphate seal solution improved adhesion relative to Comparative Example 3.

Furthermore, as illustrated in Tables 8 and 9, inclusion of FZA before cerium pretreatment improved salt spray performance and had no effect on primer adhesion. Inclusion of FZA after cerium in the phosphate seal improved primer adhesion. Inclusion of FZA before and after cerium pretreatment in phosphate seal solution improved both salt spray performance and primer adhesion. Inclusion of surfactant in cerium bath had no effect on salt spray corrosion resistance but eliminated the need to rinse panels between each step of the process.

It will be appreciated by those skilled in the art that changes could be made to the embodiments described above without departing from the broad inventive concept thereof. It is understood, therefore, that this invention is not limited to the particular embodiments disclosed, but it is intended to cover modifications which are within the spirit and scope of the invention, as defined by the appended claims.

ASPECTS OF THE INVENTION

In the following, some aspects of the invention are summarized:

1. A method for treating a substrate comprising:
   deoxidizing at least a portion of the substrate; and
   passing electric current between an anode and the substrate that has been deoxidized, serving as a cathode, said cathode and anode being immersed in an electrodepositable pretreatment composition comprising a lanthanide series element and/or a Group IIIB metal, an oxidizing agent, a metal-complexing agent, and a surfactant to deposit a coating from the electrodepositable pretreatment composition onto a surface of the substrate.
2. The method according to aspect 1, further comprising contacting at least a portion of the substrate that has deoxidized with a sealing composition comprising phosphate.
3. A method for treating a substrate comprising:
   deoxidizing at least a portion of the substrate;
   passing electric current between an anode and the substrate that has been deoxidized, serving as a cathode, said cathode and anode being immersed in an electrodepositable pretreatment composition comprising a lanthanide series element and/or a Group IIIB metal, an oxidizing agent, and a metal-complexing agent, to deposit a coating from the pretreatment composition onto a surface of the substrate; and
   at least one further step of contacting at least a portion of the substrate with a Group IIIB and/or IVB metal before and/or after the step of electrodepositing a coating from the pretreatment composition onto a surface of the substrate.
4. The method according to any of the preceding aspects, further comprising sealing the coating deposited from the electrodepositable pretreatment composition by contacting the substrate with a sealing composition comprising phosphate.
5. The method according to any of the preceding aspects, wherein at least a portion of the substrate that has the coating deposited from the electrodeposited pretreatment composition is contacted with a sealing composition comprising phosphate and a Group IIIB and/or IVB metal.
6. The method according to any of the preceding aspects, wherein the lanthanide series element and/or Group IIIB metal is present in the electrodepositable pretreatment composition in an amount from 0.01% to 10%, based on total weight of the composition.
7. The method according to any of the aspects 3-6, wherein the electrodepositable pretreatment composition further comprises a surfactant.
8. The method of any of the preceding aspects, wherein at least a portion of the substrate that has been deoxidized is contacted with a spontaneously depositable pretreatment composition comprising a Group IIIB and/or IVB metal before electric current is passed between an anode and the substrate that has been contacted with the spontaneously depositable pretreatment composition, serving as a cathode, said cathode and anode being immersed in the electrodepositable pretreatment composition.
9. The method according to aspect 8, wherein the Group IIIB and/or IVB metal is present in the spontaneously deposited pretreatment composition in an amount from 10 ppm to 500 ppm, based on total weight of the spontaneously deposited pretreatment composition.
10. The method according to aspect 8 or 9, wherein the spontaneously depositable pretreatment composition further comprises an electropositive metal.
11. The method according to aspect 10, wherein the electropositive metal is present in an amount from 1 ppm to 100 ppm, based on total weight of the spontaneously depositable pretreatment composition.
12. The method according to any of aspects 4-11, wherein the sealing composition comprises a Group IA metal phosphate, wherein the Group IA metal preferably is present in an amount from 0.001% to 5%, based on total sealing composition weight.
13. The method according to any of aspects 4-12, wherein the sealing composition further comprises a Group IIIB and/or IVB metal, wherein the Group IIIB and/or IVB metal preferably is present in the sealing composition in an amount from 1 ppm metal to 100 ppm metal (calculated as total elemental metal), based on total sealing composition weight.
14. A substrate treated according to the method of any of the preceding aspects.

We claim:

1. A substrate comprising:

a spontaneously deposited coating on at least a portion of a surface of the substrate, the spontaneously deposited coating comprising a Group IIIB metal and/or a Group IVB metal;

an electrolytically deposited coating on at least a portion of a surface of the substrate, the electrolytically deposited coating comprising a lanthanide series metal and/or a Group IIIB metal, and a metal-complexing agent; and a seal formed on at least a portion of the surface of the substrate, the seal formed from a sealing composition comprising a Group IA phosphate.

2. The substrate of claim 1, wherein the spontaneously deposited coating comprises a thickness of less than 1 micrometer.

3. The substrate of claim 1, wherein the electrodeposited coating comprises a thickness of less than 1 micrometer.

4. The substrate of claim 1, wherein the substrate comprises an aluminum alloy.

5. The substrate of claim 4, wherein the aluminum alloy comprises a 2XXX series alloy or a 7XXX series alloy.

6. The substrate of claim 1, wherein a surface of the substrate comprising the spontaneously deposited coating and/or the electrodeposited coating has less than 50 percent surface corrosion per 30 $in^2$ following 168-hour exposure to a salt spray cabinet operated according to ASTM B117.

7. The substrate of claim 5, wherein:

(a) at least 50 percent of squares of a grid formed on the surface of the substrate have a primer coating remaining on the substrate surface following soaking the substrate in deionized water for 7 days at ambient temperature, drying the substrate, adhering a filament tape to the substrate surface, and pulling the filament tape perpendicularly from the surface, wherein the grid comprises 100 squares each measuring 2 $mm^2$; and/or (b) at least 80 percent of squares of the grid formed on the surface of the substrate have a primer coating remaining on the substrate following soaking the substrate in deionized water for 7 days at ambient temperature, drying the substrate, adhering a filament tape to the substrate surface, and pulling the filament tape perpendicularly from the surface.

8. The substrate of claim 1 comprising an aircraft.

9. The substrate of claim 1 wherein:

the spontaneously deposited coating is formed from a spontaneously depositable pretreatment composition comprising a Group IIIB metal and/or a Group IVB metal; and the electrolytically deposited coating is formed from an electrodepositable pretreatment composition comprising a lanthanide series metal and/or a Group IIIB metal, an oxidizing agent, a metal-complexing agent, and a surfactant present in an amount of 0.001% to 5.0% by weight based on total weight of the electrodepositable pretreatment composition.

10. The substrate of claim 9, wherein the electrolytically deposited coating is formed by passing an electric current between an anode and the substrate, serving as a cathode, said cathode and anode being immersed in the electrodepositable pretreatment composition.

11. The substrate of claim 9, wherein the surface of the substrate is deoxidized prior to formation of the spontaneously deposited coating and the electrolytically deposited coating.

12. The substrate of claim 9, wherein the electrodepositable pretreatment composition comprises a cationic electrodepositable pretreatment composition.

13. The substrate of claim 9, wherein the spontaneously depositable pretreatment composition is capable of reacting with and chemically altering and binding to the substrate surface to form the spontaneously depositable coating in the absence of an externally applied voltage.

14. The substrate of claim 9, wherein the electrodepositable pretreatment composition is capable of reacting with and chemically altering and binding to the substrate surface to form the electrodepositable coating upon the introduction of an externally applied voltage.

15. A substrate comprising:

a spontaneously deposited coating on at least a portion of a surface of the substrate, the spontaneously deposited coating comprising a Group IIIB metal and/or a Group IVB metal;

an electrolytically deposited coating on at least a portion of a surface of the substrate, the electrolytically deposited coating comprising a lanthanide series metal and/or a Group IIIB metal, and a metal-complexing agent; and a film on at least a portion of the surface of the substrate formed from a primer composition.

16. The substrate of claim 15, wherein:

the spontaneously deposited coating is formed from a spontaneously depositable pretreatment composition comprising a Group IIIB metal and/or a Group IVB metal; and the electrolytically deposited coating is formed from an electrodepositable pretreatment composition comprising a lanthanide series metal and/or a Group IIIB metal, an oxidizing agent, a metal-complexing agent, and a surfactant present in an amount of 0.001% to 5.0% by weight based on total weight of the electrodepositable pretreatment composition.

17. The substrate of claim 15, comprising an aircraft.

18. The substrate of claim 15, wherein the spontaneously deposited coating comprises a thickness of less than 1 micrometer and/or the electrodeposited coating comprises a thickness of less than 1 micrometer.

19. The substrate of claim 15, wherein the substrate comprises an aluminum alloy.

20. The substrate of claim 15, wherein the electrolytically deposited coating is formed by passing an electric current between an anode and the substrate, serving as a cathode, said cathode and anode being immersed in the electrodepositable pretreatment composition.

* * * * *